US009954344B2

(12) United States Patent
Hattori et al.

(10) Patent No.: US 9,954,344 B2
(45) Date of Patent: Apr. 24, 2018

(54) SPARK PLUG FOR INTERNAL COMBUSTION ENGINE

(71) Applicant: DENSO CORPORATION, Kariya, Aichi-pref. (JP)

(72) Inventors: Kenji Hattori, Kariya (JP); Masamichi Shibata, Kariya (JP); Toshiya Nakamura, Kariya (JP); Yasuomi Imanaka, Kariya (JP); Hirofumi Suzuki, Kariya (JP); Hiroshi Araki, Kariya (JP); Tomoyuki Watanabe, Kariya (JP); Shin Hase, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/550,458

(22) PCT Filed: Feb. 10, 2016

(86) PCT No.: PCT/JP2016/053906
§ 371 (c)(1),
(2) Date: Aug. 11, 2017

(87) PCT Pub. No.: WO2016/129625
PCT Pub. Date: Aug. 18, 2016

(65) Prior Publication Data

US 2018/0034246 A1 Feb. 1, 2018

(30) Foreign Application Priority Data

Feb. 12, 2015 (JP) ..... 2015-025169
Jan. 14, 2016 (JP) ..... 2016-005546

(51) Int. Cl.
*H01T 13/41* (2006.01)
*H01T 13/40* (2006.01)
(Continued)

(52) U.S. Cl.
CPC ..... *H01T 13/41* (2013.01); *H01C 13/00* (2013.01); *F02P 15/00* (2013.01)

(58) Field of Classification Search
CPC ..... H01T 13/41; H01T 13/40; H01T 13/20–13/39
See application file for complete search history.

(56) References Cited

U.S. PATENT DOCUMENTS 3,967,230 A * 6/1976 Kamigaito ..... H01T 13/34 123/169 R
4,482,475 A * 11/1984 Sakai ..... H01T 13/41 252/504
(Continued)

FOREIGN PATENT DOCUMENTS

| | | |
|---|---|---|
| JP | 49-129030 | 12/1974 |
| JP | 5-152053 | 6/1993 |
| JP | 2016-004748 | 1/2016 |

OTHER PUBLICATIONS

International Search Report dated May 17, 2016 issued in corresponding Application No. PCT/JP2016/053906 (2 pages).

*Primary Examiner* — Mariceli Santiago
(74) *Attorney, Agent, or Firm* — Nixon & Vanderhye PC

(57) ABSTRACT

A spark plug 1 includes a cylindrical housing, a cylindrical insulator, a center electrode, a terminal bracket, a ground electrode, and a resistor. The insulator is held on the inside of the housing. The center electrode 4 is held on the inside of the insulator, with a tip end being projected therefrom. The terminal bracket is held on the inside of the insulator, with a base end part and being projected therefrom. The ground electrode forms a spark discharge gap G between itself and the center electrode. The resistor contains carbon and is disposed on the inside of the insulator so as to be located between the center electrode 4 and the terminal bracket. In an axial direction X of the spark plug, the resistor
(Continued)

has a higher carbon content in a first region positioned on a tip side, compared to a second region positioned on a base end side.

3 Claims, 6 Drawing Sheets

(51) Int. Cl.
*H01C 13/00* (2006.01)
*F02P 15/00* (2006.01)

(56) References Cited

U.S. PATENT DOCUMENTS

| | | | | |
|---|---|---|---|---|
| 2011/0248620 | A1* | 10/2011 | Shibata ..... | H01C 7/003<br>313/141 |
| 2013/0264939 | A1 | 10/2013 | Fukushima et al. | |
| 2014/0116901 | A1 | 5/2014 | Dressel et al. | |
| 2014/0116902 | A1 | 5/2014 | Dressel et al. | |
| 2016/0204579 | A1 | 7/2016 | Yoshida et al. | |
| 2016/0204580 | A1 | 7/2016 | Yoshida et al. | |

* cited by examiner

SPARK PLUG FOR INTERNAL COMBUSTION ENGINE

CROSS-REFERENCE TO RELATED APPLICATION

This application is the U.S. national phase of International Application No. PCT/JP2016/053906 filed on Feb. 10, 2016 which designated the U.S. and claims the benefit of priority from earlier Japanese Patent Applications No. 2015-025169 filed on Feb. 12, 2015 and No. 2016-005546 filed on Jan. 14, 2016, the entire contents of each of which are hereby incorporated by reference.

TECHNICAL FIELD

The present disclosure relates to a spark plug for an internal combustion engine having a resistor.

BACKGROUND ART

A spark plug is installed in a combustion chamber of an internal combustion engine of a vehicle or the like, as an ignition means for igniting a fuel-air mixture. The spark plug includes a cylindrical housing and a cylindrical insulator held on the inside of the housing. The spark plug also includes a center electrode held on the inside of the insulator with a tip end thereof being projected from the insulator, and a ground electrode forming a spark discharge gap between itself and the center electrode.

With the spark plug having the aforementioned configuration, there is a risk that radio noise is generated due to the spark discharge occurring in the spark discharge gap, and this may adversely affect the peripheral devices. To prevent such radio noise, a resistor is disposed on the base end side of the center electrode.

PTL 1 discloses the following resistor as a resistor of a spark plug to prevent radio noise. PTL 1 discloses a resistor in which the resistance in a region closer to the tip side (tip side region) than the center in the axial direction of the spark plug is made higher than the resistance in a region closer to the base end side (base end side region) than the center in the axial direction. Resistivity of the resistor in the axial direction is adjusted by appropriately adjusting, in the axial direction, the amount of carbon contained in the resistor. Namely, the resistor in the spark plug described in PTL 1 has a lower carbon content in the tip side region than in the base end side region.

CITATION LIST

Patent Literature

[PTL 1] JP 2012-129132 A

SUMMARY OF THE INVENTION

Technical Problem

However, when a spark plug having a resistor is installed in a combustion chamber such as of a supercharged engine or a high compression ratio engine, there is a concern of a phenomenon occurring in which oxygen is supplied to the resistor from a glass seal filled in the resistor on its tip side, as the internal pressure of the combustion chamber increases. In this case, there is a risk that the carbon contained near the tip end of the resistor oxidizes and increases electrical resistance. Moreover, the tip side region of the resistor near the combustion chamber (discharge unit) tends to have high temperature, and thus the carbon is easily oxidized. When the resistance of the resistor increases, there is a risk that the internal combustion engine may be misfired.

Further, with the increase of the internal pressure of the combustion chamber, the required voltage of the spark plug is likely to increase, and the capacitive discharge current is likely to increase. As a result, heat generated in the resistor easily increases, and thus there is a concern that the lifetime of the resistor is shortened.

However, when carbon is sufficiently present in the tip end portion of the resistor, even if the carbon is oxidized as mentioned above, the resistance of the resistor is unlikely to increase to an extent of causing a problem in the function of the spark plug.

The carbon content of the entirety of the resistor is designed to ensure the noise prevention performance of the resistor. With such a design, when the carbon content of the tip side region of the resistor is lower than the base end side region as in the spark plug described in PTL 1, there is a concern that the resistance of the resistor increases, along with the oxidation of the carbon as mentioned above.

It is an object of the present disclosure to provide a spark plug for an internal combustion engine, which ensures radio noise prevention performance, and prevents increase of electrical resistance of the resistor.

Solution to Problem

According to an aspect of a spark plug for an internal combustion engine of the present disclosure, the spark plug includes:

a cylindrical housing;

a cylindrical insulator held on the inside of the housing;

a center electrode held on the inside of the insulator so that a tip end of the center electrode is project from the insulator;

a terminal bracket held on the inside of the insulator so that a base end of the terminal bracket is projected from the insulator;

a ground electrode forming a spark discharge gap between the ground electrode and the center electrode; and a resistor containing carbon disposed on the inside of the insulator so as to be located between the center electrode and the terminal bracket, wherein:

in an axial direction of the spark plug, the resistor has a higher carbon content in a first region positioned closer to a tip side than a center of the resistor is, compared to a second region positioned closer to a base end side than the center of the resistor is.

The resistor of the spark plug for an internal combustion engine has a higher carbon content in a first region on a tip side than in a second region on a base end side. Thus, the spark plug of the present disclosure can suppress the increase of resistance over time in the resistor. Namely, in the spark plug of the present disclosure, the first region on the tip side where oxidation occurs easily is permitted to have a higher carbon content to suppress increase of resistance in the resistor due to oxidation of the carbon.

In the spark plug of the present disclosure, the second region, on the base end side, is permitted to have a lower carbon content to increase resistance in the second region and to thereby suitably adjust resistance of the entirety of the resistor. Thus, the spark plug of the present disclosure can sufficiently suppress radio noise generated due to spark discharge.

In this way, the present disclosure can provide a spark plug for an internal combustion engine which ensures the performance of suppressing radio noise and prevents the increase of electrical resistance of the resistor.

DESCRIPTION OF THE EMBODIMENTS

The spark plug for an internal combustion engine of the present disclosure can be used, for example, in an internal combustion engine such as of a motor vehicle or a cogeneration system.

With reference to the drawings, some embodiments of a spark plug for an internal combustion engine of the present disclosure will be described below. In the following description, the side toward which the spark plug is inserted into the combustion chamber of the internal combustion engine in the axial direction of the spark plug is referred to as tip side, and the side opposite thereto is referred to as base end side.

[First Embodiment]

Figure 1:
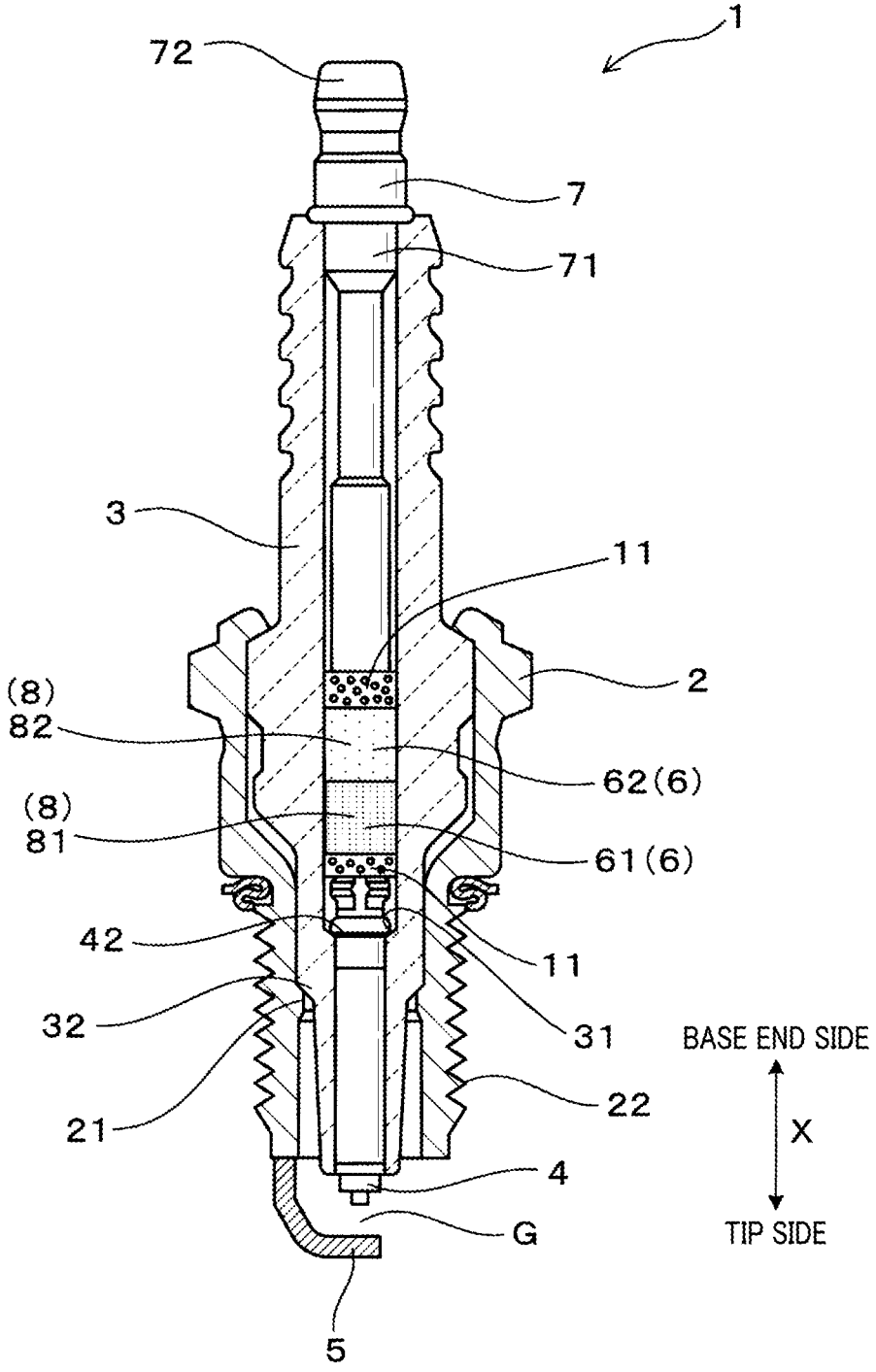
FIG. 1 is a cross-sectional view of a spark plug for an internal combustion engine according to a first embodiment.

Referring to FIG. 1, an embodiment of a configuration of a spark plug for an internal combustion engine according to the present embodiment will be described.

As shown in FIG. 1, a spark plug 1 for an internal combustion engine according to the present embodiment includes a cylindrical housing 2, a cylindrical insulator 3, a center electrode 4, a terminal bracket 7, a ground electrode 5, and a resistor 6. The insulator 3 is held on the inside of the housing 2. The center electrode 4 is held on the inside of the insulator 3 so that the tip end is projected from the insulator 3. The terminal bracket 7 is held on the inside of the insulator 3 so that the base end part is projected from the insulator 3. The ground electrode 5 forms a spark discharge gap G with the center electrode 4. The resistor 6 containing carbon is disposed on the inside of the insulator 3 so as to be located between the center electrode 4 and the terminal bracket 7. The resistor 6 has a higher carbon content in a first region 61 located on its tip side with respect to the center of the resistor 6 in an axial direction X, than in a second region 62 located on its base end side with respect to the center of the resistor 6 in the axial direction X. In the present embodiment, for example, carbon content (wt %) in the first region 61 may be in the range of 1.7 to 1.9 wt %. Further, in the present embodiment, carbon content (wt %) in the second region 62 may be in the range of 1.1 to 1.3 wt %.

The insulator 3 is an electrical insulator formed such as of alumina. The insulator 3 is held on the inside of the housing 2 which is made of metal, such as an Fe-based alloy. The insulator 3 is provided with a plurality of regions in the axial direction X with different outer diameters, and is formed with an outer shoulder 32 between the regions. Further, the housing 2 is provided with a plurality of regions in the axial direction X with different inner diameters, and is formed with an inner shoulder 21 between the regions. The insulator 3 is supported in the axial direction X via the outer shoulder 32 by the inner shoulder 21 of the housing 2, and held in the housing 2. The housing 2 has a mounting thread 22 for mounting the spark plug 1 to the internal combustion engine. The mounting thread 22 is inserted head-on from its tip side into the combustion chamber of the internal combustion engine. Part (joint) of the housing 2 is crimped to mechanically fix the insulator 3 held on the inside thereof.

The center electrode 4 is a columnar member made of a metal material, such as an Ni-based alloy, with a metal material having good thermal conductivity, such as Cu, being arranged on the inside of the center electrode 4. The center electrode 4 is held on the inside of the insulator 3. The insulator 3 includes a plurality of regions in the axial direction X with different outer diameters, and an inner shoulder 31 is formed between the regions. The center electrode 4 includes a plurality of regions with different outer diameters, and an outer shoulder 42 is formed between the regions. The center electrode 4 is supported in the axial direction X via the outer shoulder 42 by the inner shoulder 31 of the insulator 3 and held in the insulator 3. The tip of the center electrode 4 is exposed and projected, on its tip side, from the insulator 3.

The ground electrode 5 is disposed on the tip side of the housing 2. The ground electrode 5 extends straight, in a direction orthogonal to the axial direction X, toward the center axis of the spark plug. The ground electrode 5 is disposed to face a tip of the center electrode 4 in the axial direction X. Thus, the spark discharge gap G is formed between the center electrode 4 and the ground electrode 5.

The resistor 6 is disposed on the inside of the insulator 3, by being inserted, via a glass seal 11, from the base end side of the center electrode 4. The glass seal 11 is made of copper glass produced by mixing copper powder (Cu) in glass.

The resistor 6 is a columnar member formed by sintering, in a heating furnace, a powdered resistor material which is mixed with a carbon powder and contains glass as a main component. The resistor 6 is formed so that the carbon content in the first region 61 will be greater than in the second region.

The resistor 6 has at least two uniform portions 8 in the axial direction X, in each of which the carbon content is uniform. Of the uniform portions, at least one uniform portion 8 serves as a tip side portion 81 disposed on the tip side of the resistor 6. The carbon content of the tip side portion 81 is higher than that of the other uniform portion 8 which includes a base end side portion 82 disposed on the base end side of the resistor 6.

The resistor 6 according to the present embodiment includes two uniform portions 8, i.e. the tip side portion 81 and the base end side portion 82. In the resistor 6 according to the present embodiment, the tip side portion 81, which is one of the uniform portions 8, is disposed in the first region 61, and the base end side portion 82, which is the other uniform portion 8, is disposed in the second region 62. In short, in the resistor 6 according to the present embodiment, the carbon content in each of the first and second regions 61 and 62 is uniform. In the resistor 6 according to the present embodiment, the carbon content is different across the boundary between the first and second regions 61 and 62, the boundary being positioned in the center of the resistor 6 in the axial direction X. Therefore, in the resistor 6 according to the present embodiment, the electrical resistivity in the second region 62 is higher than in the first region 61.

The metal terminal bracket 7 made of an iron alloy and the like is disposed on the base end side of the resistor 6 via the glass seal 11. The terminal bracket 7 includes a bracket body 71 and a terminal 72. The bracket body 71 is inserted and held on the inside of the cylindrical insulator 3. The terminal 72 is disposed on the base end side of the bracket body 71 so as to be exposed, on its base end side, from the insulator 3. The terminal 72 is connected to an ignition coil (not shown).

The following description addresses an example of a measurement method of the carbon content (wt %) in each of the first and second regions 61 and 62 of the resistor 6 according to the present embodiment.

In the present measurement method, first, the resistor 6 is extracted from the spark plug 1. Then, in the present measurement method, the extracted resistor 6 is cut at the center thereof in the axial direction X, to obtain the first and second regions 61 and 62. Moreover, in the present measurement method, the obtained first and second regions 61 and 62 are crushed, and the carbon content of each region is measured with a measurement device. The measurement device used, for example, is an EMIA (registered trademark) that is an analyzer manufactured by Horiba Ltd.

An example of a method of confirming whether the uniform portion 8 is present in the resistor 6 according to the present embodiment will be described. Also, an example of a method of confirming the boundary position between the uniform portions 8 (the tip side portion 81 and the base end side portion 82) will be described.

In the confirmation method, first, the extracted resistor 6 is equally cut into ten in the axial direction X, to prepare ten test pieces. Then, in the present confirmation method, the carbon content is measured for each test piece with the aforementioned measurement device. Further, in the present confirmation method, the measurement values of adjacent test pieces in the axial direction X are compared. As a result of the comparison, those test pieces which have the same measurement value are understood to be part of the same uniform portion 8. From these results, it is confirmed in the present confirmation method as to whether there is a uniform portion 8 in the resistor 6.

The test results of the test pieces according to the aforementioned method are taken to be as follows. For example, the carbon content of each of the three test pieces (from the first to the third) in order from the tip side of the resistor 6 is 2 wt %, and the carbon content of each of the remaining seven (from the fourth to the tenth) test pieces is 1.5 wt %. In this case, it is understood that the position between the third and fourth test pieces from the tip side of the resistor 6 is the boundary position between the uniform portions 8. From these results, in the present confirmation method, the boundary position between the uniform portions 8 present in the resistor 6 can be confirmed.

Also, the test results of the test pieces according to the aforementioned method are taken to be as follows. For example, the carbon content of each of the three test pieces in order from the tip side of the resistor 6 is 2 wt %, and the carbon content of the fourth test piece from the tip side is 1.7 wt %. Further, the carbon content of each of the six test pieces from the fifth to tenth is 1.5 wt %. In this case, it is understood that the three test pieces from the first to third are part of a uniform portion 8, and the six test pieces from the fifth to tenth are part of another uniform portion 8. Therefore, in the case of the present test results, it is understood that, of the test pieces for which the measurement values are different than the carbon content of the test pieces adjacently located on the tip side of the resistor 6, the test piece positioned closest to the test pieces adjacently located on the tip side includes the boundary between the uniform portions 8. Namely, in the case of the present test results, it is understood that, of the fourth and fifth test pieces for which the measurement values are different than the carbon content of the three first to third test pieces, the fourth test piece positioned closest to the three test pieces adjacently located on the tip side includes the boundary between the uniform portions 8.

Hereinafter, an example of the production method of the spark plug 1 for an internal combustion engine according to the present embodiment will be described.

In the production method, first, the center electrode 4 is inserted into the cylindrical insulator 3 and disposed therein, with part of the tip of the center electrode 4 being projected, on its tip side, from the insulator 3. Then, in the production method, a material powder of the glass seal 11 is filled in the insulator 3 from its base end side, and the filled material powder of the glass seal 11 is pressed in the axial direction X. Then, in the production method, a material powder of the resistor 6 is filled in the insulator 3 so as to be located on the base end side of the material powder of the glass seal 11. Examples of the material powder of the resistor 6 include carbon powder, glass powder, zirconia powder and the like. Two types of material powders (the first material powder and the second material powder) having different carbon powder contents are used as the material powders of the resistor 6.

In the production method, the first material powder with a comparatively high carbon powder content is filled in the insulator 3. In this case, the carbon powder content of the first material powder of the resistor 6 to be filled is, for example, in the range of 1.7 to 1.9 wt %. Then, in the production method, the second material powder with a comparatively low carbon powder content is filled in the insulator 3 so as to be located on the base end side of the previously filled first material powder. In this case, the carbon powder content of the second material powder of the resistor 6 to be filled is, for example, in the range of 1.1 to 1.3 wt %.

Then, in the production method, the filled material powder of the resistor 6 is pressed in the axial direction X. Then, in the production method, a material powder of the glass seal 11 is further filled in the insulator 3 so as to be located on the base end side of the material powder of the resistor 6. Then, in the production method, the terminal bracket 7 is inserted into the cylindrical insulator 3 head-on from its bracket body 71 side, and the material powder of the glass seal 11 is pressed in the axial direction X with the insertion of the bracket body 71.

Then, in the production method, the insulator 3, which has been filled with the material powders of the glass seal 11 and the resistor 6 and inserted with the center electrode 4 and the terminal bracket 7, is heated in a heating furnace (e.g., electric furnace). Thus, in the production method, there is obtained an insulator 3 in which the center electrode 4, the resistor 6, the glass seal 11, and the terminal bracket 7 are provided on the inside. Further, in the production method, there is obtained a resistor 6 in which the tip side portion 81 that is a uniform portion 8 is provided in the first region 61, and the base end side portion 82 that is another uniform portion 8 having a lower carbon content than the tip side portion 81 is provided in the first region 61.

In the production method, the insulator 3 including therein the center electrode 4, the resistor 6, the glass seal 11, and the terminal bracket 7 is held on the inside of the housing 2 which is provided with the ground electrode 5.

Thus, the spark plug 1 for an internal combustion engine according to the present embodiment is obtained.

The following description sets forth the advantageous effects of the spark plug 1 for an internal combustion engine, according to the present embodiment.

The resistor 6 of the spark plug 1 for an internal combustion engine according to the present embodiment has a higher carbon content in the first region 61 on the tip side than in the second region 62 on the base end side. Thus, the spark plug 1 according to the present embodiment suppresses the increase of resistance over time in the resistor 6. Namely, the spark plug 1 according to the present embodiment is permitted to have a high carbon content in the first region 61 on the tip side where oxidation occurs easily, to thereby suppress the increase of resistance in the resistor 6 due to oxidation of the carbon.

Figure 2:
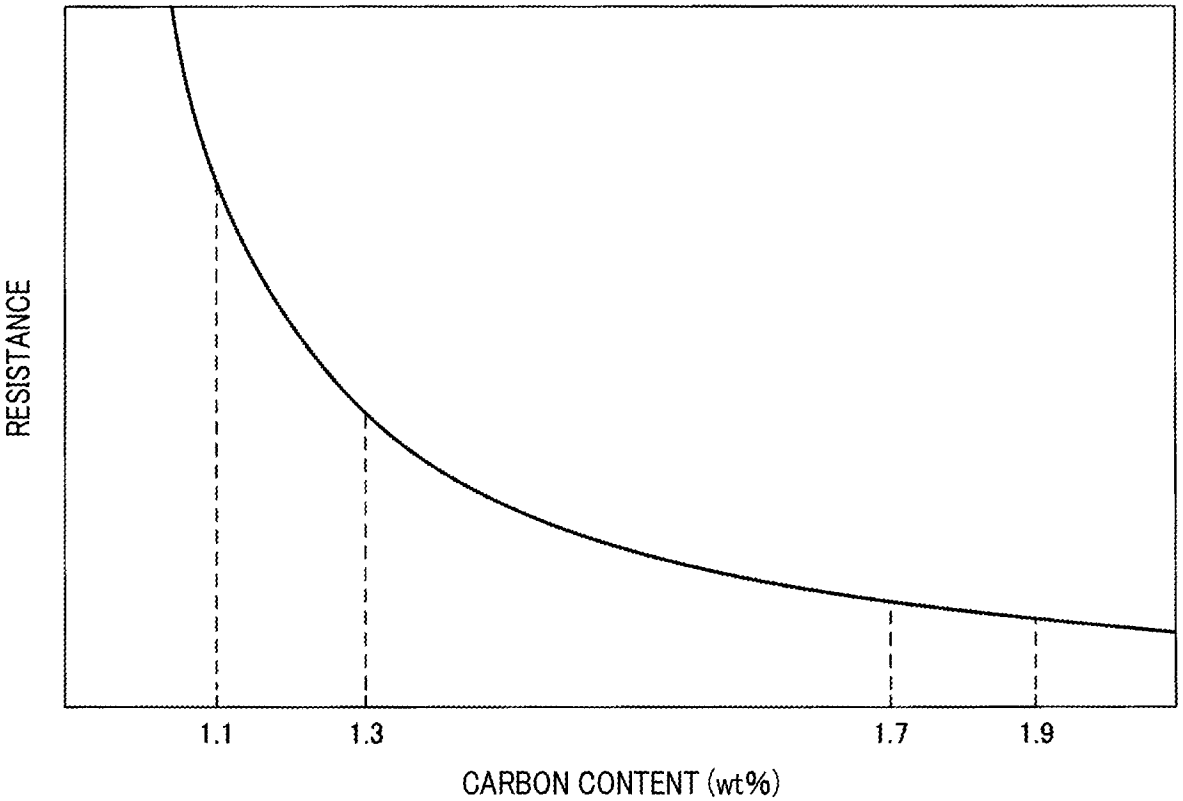
FIG. 2 is a graph showing a relationship between carbon content and resistance in a first region.

FIG. 2 indicates a relationship between carbon content in the first region 61 and resistance of the resistor 6 according to the present embodiment.

As shown in FIG. 2, the change of resistance accompanying the change of carbon content tends to be large when the carbon content in the first region 61 is low. For example, when the carbon content of the first region 61 decreases from 1.3 wt % to 1.1 wt %, the increase of resistance in the first region 61 is large. With respect thereto, if the carbon content in the first region 61 of the resistor 6 is high, the change of resistance accompanying the change of carbon content tends to be small. For example, even if the carbon content of the first region 61 decreases from 1.9 wt % to 1.7 wt %, the increase of resistance in the first region 61 is small.

In short, by increasing the carbon content of the first region 61, the spark plug 1 according to the present embodiment can suppress the increase of resistance in the first region 61 due to oxidation of the carbon. As a result, the spark plug 1 suppresses the increase of resistance over time in the entirety of the resistor 6.

Further, the spark plug 1 according to the present embodiment can increase resistance in the second region 62 by decreasing the carbon content of the second region 62. As a result, the spark plug 1 adjusts resistance in the entirety of the resistor 6 to a suitable value. Therefore, the spark plug 1 sufficiently suppresses the radio noise generated due to the spark discharge.

Further, the resistor 6 according to the present embodiment has at least two uniform portions 8 in the axial direction X in each of which the carbon content is uniform. Therefore, the present embodiment can obtain an easy-to-manufacture spark plug 1.

As described above, the present embodiment can provide a spark plug 1 for an internal combustion engine, which ensures performance of suppressing radio noise, and prevents increase of electrical resistance in the resistor 6.

EXPERIMENTAL EXAMPLE 1

In the present experimental example, carbon content of the entirety of the resistor 6 was kept unchanged, and the carbon content of each of the first region 61 and the second region of the resistor 6 was changed in each spark plug. In the present experimental example, the carbon content of each of the first and second regions of the resistor 6 was changed so as to be different between spark plugs, and the rate of change of the electrical resistance was evaluated for each spark plug.

Specifically, in the present experimental example, the following three spark plugs (Samples 1 to 3) were prepared. Sample 1 was a spark plug 1 having the resistor 6 of first embodiment. Namely, Sample 1 was a spark plug 1 with the resistor 6 in which the carbon content in the first region 61 was higher than in the second region 62. Sample 2 was a spark plug having the same basic configuration as the spark plug 1 of first embodiment, and used a resistor 6 in which the carbon contents of the first region 61 and the second region were equivalent. Sample 3 was a spark plug having the same basic configuration as the spark plug 1 of first embodiment, and used a resistor 6 in which the carbon content in the second region 62 was higher than in the first region 61.

In the present experimental example, discharge tests were conducted for the three spark plugs in a 350° C. heating furnace by applying a discharge voltage of 20±5 kV across the center electrode 4 and the ground electrode 5, and repeating discharge at a frequency of 60 Hz. In the present experimental example, the electrical resistance between the center electrode 4 and the terminal bracket 7 was measured before and after each discharge test, and the rate of increase of electrical resistance (resistance increase rate) after the discharge test was calculated relative to the resistance before the discharge test. The test for each of the samples (Samples 1 to 3) was continued until when the rate of increase of resistance was confirmed to exceed 100%. The calculation was based on the following Formula (1), where $R_c$ was a resistance increase rate, $R_0$ was an electrical resistance before test, and $R_1$ was an electrical resistance after test.

$$R_c=100\times(R_1-R_0)/R_0 \quad (1)$$

Figure 3:
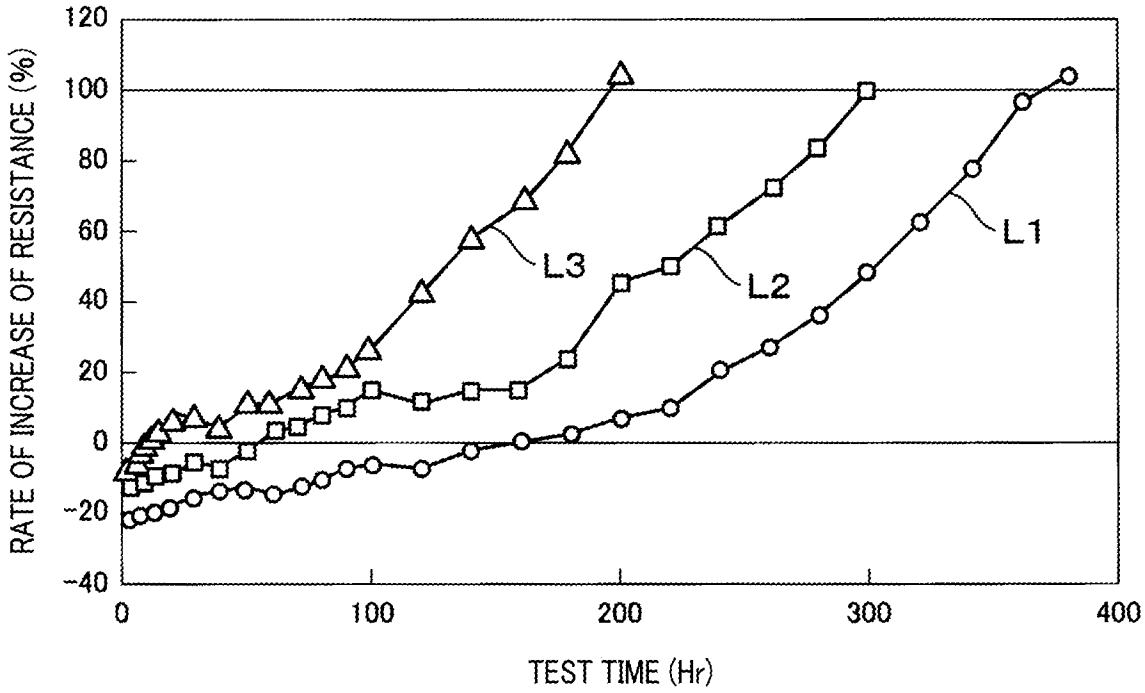
FIG. 3 is a graph showing a relationship between test time and rate of increase of resistance in Experimental Example 1.

The test results of the present experimental example are shown in FIG. 3. In FIG. 3, the horizontal axis represents test time (units: Hr) and the vertical axis represents resistance increase rate $R_c$ (units: %). The relationship between test time and resistance increase rate $R_c$, in each of the samples (Samples 1 to 3) is plotted as a graph shown in FIG. 3. Specifically, the results of Sample 1 are represented by a graph L1 in which circular marks are connected by a line. The results of Sample 2 are represented by a graph L2 in which square-shaped marks are connected by a line. The results of Sample 3 are represented by a graph L3 in which triangular marks are connected by a line.

The test results of the present experimental example will be explained. As shown in FIG. 3, it is understood from the present experimental example that the resistance increase rate $R_c$ in the samples tends to gradually increase with the elapse of test time. Further, it is understood from the present experimental example that, compared with Samples 2 and 3, the resistance increase rate $R_c$ of Sample 1 with the elapse of test time is suppressed.

[Second Embodiment]

Figure 4:
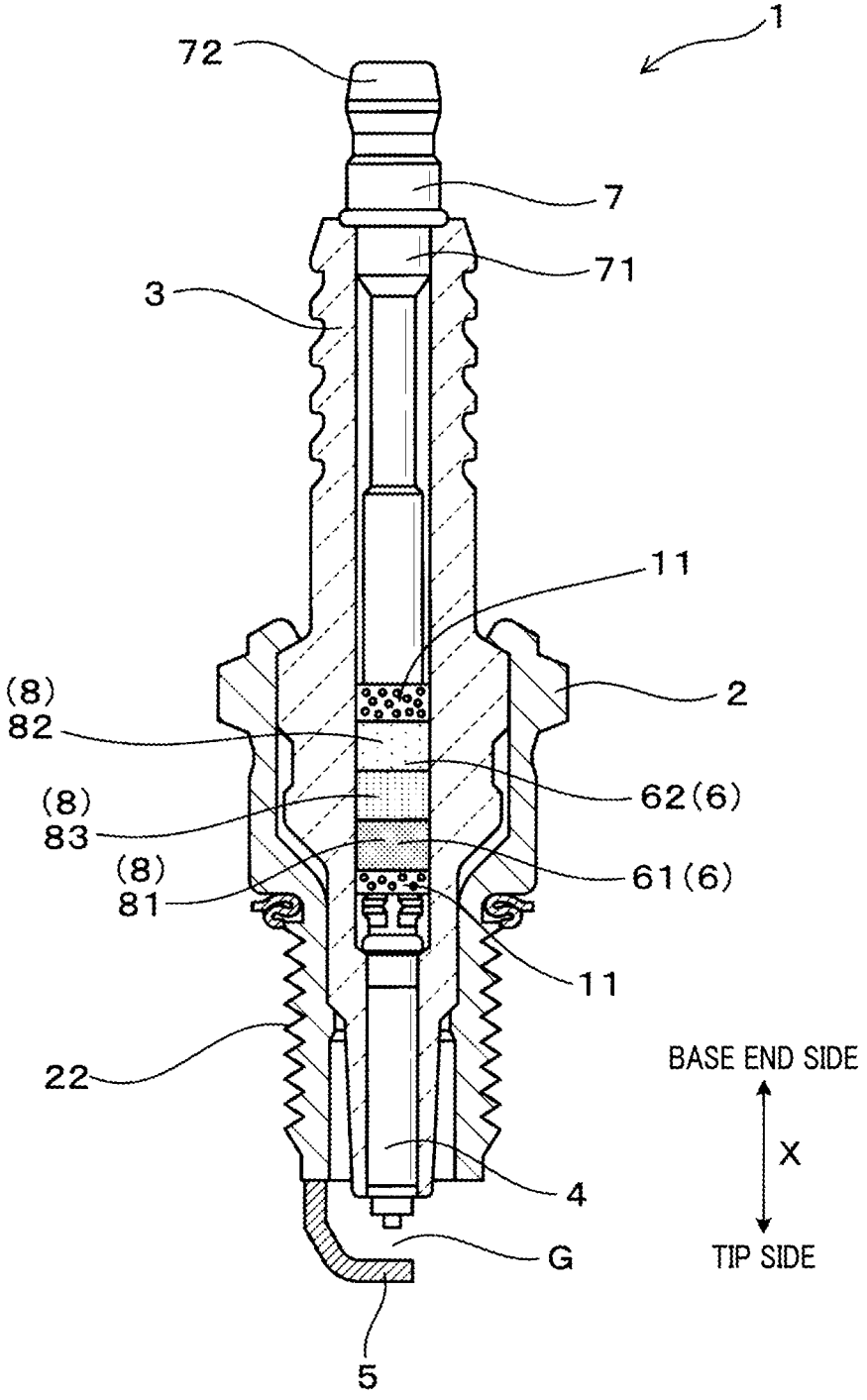
FIG. 4 is a cross-sectional view of a spark plug for an internal combustion engine according to a second embodiment.

Referring now to FIG. 4, an example of the configuration of a spark plug for an internal combustion engine according to the present embodiment will be described. As shown in FIG. 4, in a spark plug 1 for an internal combustion engine according to the present embodiment, the resistor 6 includes at least three uniform portions 8 in the axial direction X. Namely, the resistor 6 according to the present embodiment includes a tip side portion 81 formed on the tip side of the uniform portions 8 and a base end side portion 82 formed on the base end side thereof. Further, the resistor 6 includes an intermediate portion 83 formed between the tip side portion 81 and the base end side portion 82. In the present embodiment, the lengths in the axial direction X of the tip side portion 81, the intermediate portion 83, and the base end side portion 82 are the same, but the embodiment is not limited thereto.

The carbon content of the tip side portion 81 is higher than each of the carbon contents of the intermediate portion 83 and the base end side portion 82. Further, the carbon content of the intermediate portion 83 is higher than the carbon content of the base end side portion 82. In the present embodiment as well, the resistor 6 has a higher carbon content in the first region 61 positioned closer to the tip side than the center in the axial direction X, compared to the second region 62 positioned closer to the base end side than the center. In other words, in the resistor 6 according to the present embodiment, the carbon content in the first region 61 including the tip side portion 81 and a tip side part of the intermediate portion 83 is higher than the second region 62 including the base end side portion 82 and a base end side part of the intermediate portion 83. Therefore, in the resistor 6 according to the present embodiment, the electrical resistivity in the second region 62 becomes higher than in the first region 61.

In this way, the first region 61 of the resistor 6 according to the present embodiment includes the tip side portion 81 and a tip side part of the intermediate portion 83 (two uniform portions 8) in which the carbon contents are different from each other. Further, the second region 62 includes the base end side portion 82 and a base end side part of the intermediate portion 83 (two uniform portions 8) in which the carbon contents are different from each other.

The rest of the configuration is the same as in the first embodiment. Note that, of the reference signs used in describing the present embodiment, the same reference signs as those used in the first embodiment represent the same constituent elements as in the first embodiment, unless specifically indicated, and thus description is omitted.

With the aforementioned configuration, the present embodiment also provides the same advantageous effects as in the first embodiment.

In the present embodiment, the carbon content of the intermediate portion 83 is higher than the carbon content of the base end side portion 82, but it is not limited thereto. Namely, the first region of the resistor 6 only needs to have a higher carbon content than in the second region.

EXPERIMENTAL EXAMPLE 2

Figure 5:
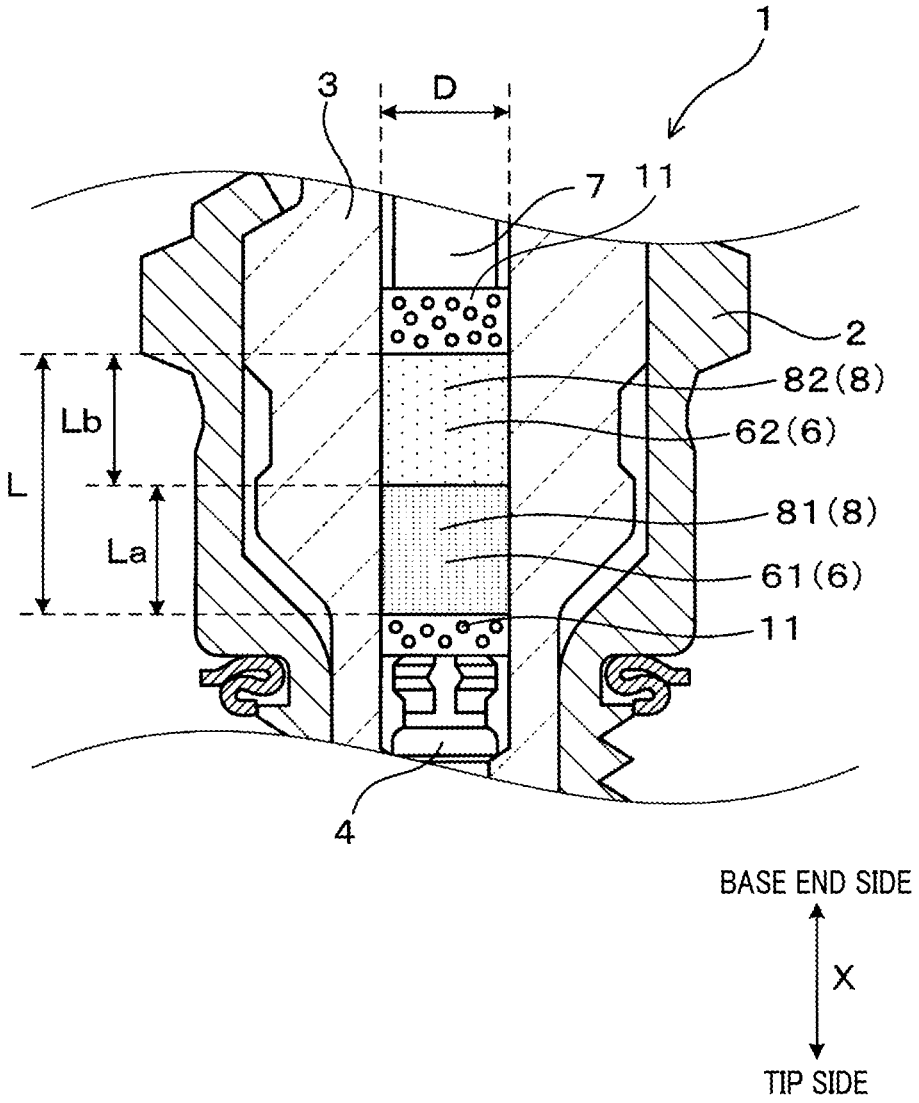
FIG. 5 is an enlarged view in the vicinity of the resistor shown in FIG. 1.

The present experimental example will be explained referring to FIG. 5. FIG. 5 is an enlarged view in the vicinity of the resistor 6 shown in FIG. 1. As shown in FIG. 5, in the spark plug 1 including the resistor 6 with two uniform portions 8 as in the first embodiment, L indicates a total length (units: mm) of the resistor 6 in the axial direction X, and La indicates a length (units: mm) of the tip side portion 81. In the present experimental example, the ratio (La/L) of the length La relative to the total length L (units: mm) was changed. In the following description, for the sake of convenience, the ratio (La/L) of the length La of the tip side portion 81 relative to the total length L of the resistor 6 in the axial direction X is referred to as length ratio. In the present experimental example, the effects of the change of length ratio (La/L) on the resistor lifetime were evaluated.

Specifically, the present experimental example used the spark plug 1 having the same basic configuration as in the first embodiment. In the present experimental example, as shown in the following Table 1, nine spark plugs 1 (Samples α1 to α9) were prepared in each of which the length ratio (La/L) in the axial direction X was changed within the range of 0.1 to 0.9 by a unit of 0.1. Further, in the present experimental example, a comparative sample was also prepared as an object to be compared. The comparative sample included a resistor 6 with a uniform portion 8 in which the carbon content was uniform over the total length L.

The total length L of the resistor 6 in all the comparative sample and the samples (Samples α1 to α9) was 10 mm. Further, the samples had the same dimension in the inner diameter D of the insulator 3 in the position where the resister 6 was disposed in the axial direction X, and the same resistance R of the entirety of the resistor 6. Namely, in each sample, the inner diameter D of the insulator 3 was 3 mm, and the resistance R of the entirety of the resistor 6 was 5 kΩ.

For the sake of convenience, in the following description, the carbon content of the tip side portion 81, i.e., the proportion of the weight of the carbon in the tip side portion 81 relative to the weight of the entirety of the tip side portion 81, is expressed as carbon content C1. Further, the carbon content in the base end side portion 82, i.e., the proportion of the weight of the carbon in the base end side portion 82 relative to the weight of the entirety of the base end side portion 82, is expressed as carbon content C2. In each of the samples (Samples α1 to α9) of the present experimental example, the carbon content C2 of the base end side portion 82 was set to 1.5 wt %, and the carbon content C1 of the tip side portion 81 was adjusted so that the resistance of the entirety of the resistor 6 was 5 kΩ. All the samples satisfied the condition of a ratio of the carbon content C1 relative to the carbon content C2 (C1/C2) being 1.1 or more (C1/C2≥1.1). The proportion of the weight of the carbon of the entirety of the resistor 6 relative to the weight of the entirety of the resistor 6 in the comparative sample was 1.5 wt %. In the following description, the ratio of the carbon content C1 relative to the carbon content C2 (C1/C2) is referred to as content ratio.

The test conditions of the present experimental example were made more severe than those of the resistor load life-span test specified in JIS B8031 (2006).

In the present experimental example, discharge tests were conducted for the samples (Samples α1 to α9) by applying a discharge voltage 35 kV higher than 20±5 Kv, which was the condition of the discharge voltage of the aforementioned standard, across the center electrode 4 and the ground electrode 5, and repeating discharge at a frequency of 100 Hz. In this case, each sample was disposed in a 350° C. heating furnace to make the conditions more severe than the aforementioned standard. In the present embodiment, the test was continued until the absolute value of the resistance increase rate $R_c$ exceeded 30, and the time of which was measured as the resistor lifetime. Table 1 shows the measurements (test results). Similar to Experimental Example 1, the resistance increase rate $R_c$ of the present experimental example is the rate of increase of electrical resistance between the center electrode 4 and the terminal bracket 7 after the discharge test, relative to the electrical resistance before the discharge test.

TABLE 1

| | Carbon content C1 [wt %] | Carbon content C2 [wt %] | C1/C2 [-] | Length La [mm] | Length Lb [mm] | Total length L [mm] | La/L [-] | Inner diameter D [mm] | Resistance R [kΩ] | Resistor lifetime [hr] | Evaluation |
|---|---|---|---|---|---|---|---|---|---|---|---|
| Comparative sample | 1.5 (Carbon content of the entirety of the resistor) | | — | — | — | 10 | — | 3 | 5 | 30 | B |
| Sample α1 | 1.6 | 1.5 | 1.1 | 1 | 9 | 10 | 0.1 | 3 | 5 | 60 | S |
| Sample α2 | 1.7 | 1.5 | 1.1 | 2 | 8 | 10 | 0.2 | 3 | 5 | 80 | S |
| Sample α3 | 1.8 | 1.5 | 1.2 | 3 | 7 | 10 | 0.3 | 3 | 5 | 110 | S |
| Sample α4 | 1.8 | 1.5 | 1.2 | 4 | 6 | 10 | 0.4 | 3 | 5 | 110 | S |
| Sample α5 | 1.9 | 1.5 | 1.3 | 5 | 5 | 10 | 0.5 | 3 | 5 | 120 | S |
| Sample α6 | 1.9 | 1.5 | 1.3 | 6 | 4 | 10 | 0.6 | 3 | 5 | 90 | S |
| Sample α7 | 1.9 | 1.5 | 1.3 | 7 | 3 | 10 | 0.7 | 3 | 5 | 70 | S |
| Sample α8 | 2 | 1.5 | 1.3 | 8 | 2 | 10 | 0.8 | 3 | 5 | 30 | B |
| Sample α9 | 2 | 1.5 | 1.3 | 9 | 1 | 10 | 0.9 | 3 | 5 | 20 | B |

In Table 1, as well as in Tables 2 to 4 described later, the symbol S, A or B shown in the column "Evaluation" was appended to the samples based on the following criteria, as reference information for evaluating the effects on the resistor lifetime.

Evaluation S: Resistor lifetime was 60 hours or more

Evaluation A: Resistor lifetime was 40 hours or more to less than 60 hours

Evaluation B: Resistor lifetime was less than 40 hours

In the present experimental example, there were no samples in which the resistor lifetime was 40 hours or more to less than 60 hours. Therefore, Table 1 does not show Evaluation A.

The aforementioned JIS standards require the absolute value of the resistance increase rate $R_c$ after $1.3\times10^7$ ignitions to be 30 or less. The $1.3\times10^7$ ignitions correspond to the test condition of frequency of 100 Hz of the present experimental example, which is 40 hours in terms of time. In the present experimental example, Evaluation A is distinguished from Evaluation B with reference to the 40 hours. However, as stated above, the tests in the present experimental example were conducted under conditions more severe than the aforementioned JIS standards. Therefore, in the present experimental example, the sample with Evaluation B does not necessarily mean that the sample does not satisfy the requirements of the aforementioned JIS standards.

The test results in the present experimental example will be explained. As shown in Table 1, it is understood from the present experimental example that when the length ratio (La/L) in the axial direction X is in the range of 0.1 or more to 0.7 or less, the resistor lifetime is 60 hours or more. In the following description, for the sake of convenience, the requirement of 0.1 or more to 0.7 or less ($0.1\leq La/L\leq 0.7$) (numerical requirement for the length ratio in the axial direction X) mentioned above is referred to as Requirement [1]. Therefore, it is understood from the present experimental example that the service life of the resistor 6 can be specifically extended by the length ratio (La/L) satisfying Requirement [1].

However, as shown in Table 1, it is understood from the present experimental example that when the length ratio (La/L) in the axial direction X is greater than 0.7 ($La/L>0.7$), the resistor lifetime is less than 40 hours. This is considered to be due to the following reasons. When the length ratio (La/L) exceeds 0.7, and when the material powder of the resistor 6 is pressed in the axial direction X during manufacture of the spark plug 1, the pressing force is unlikely to sufficiently act from the base end side to the tip side of the resistor 6. Thus, in the resistor 6, the density of the material powder in the vicinity of the tip surface specifically tends to be low. Therefore, the electrical resistivity of the tip side portion 81 is locally higher in the vicinity of the tip surface. As a result, it is considered that generation of Joule heat at the time of energization is promoted to thereby shorten the resistor lifetime.

EXPERIMENTAL EXAMPLE 3

In the present experimental example, similar to the first embodiment, the carbon content C1 of the tip side portion 81, the carbon content C2 of the base end side portion 82, and the carbon content ratio of the tip side relative to the base end side (C1/C2) were changed in the spark plug 1 that included the resistor 6 having two uniform portions 8. In the present experimental example, the effect of changing the carbon content ratio (C1/C2) on the resistor lifetime was evaluated.

In the present embodiment, explanation on the terms of carbon content C1, carbon content C2, and resistor lifetime is omitted, as they have already been explained. The same applies to other experimental examples described later.

Specifically, the spark plug 1 having the same basic configuration as in the first embodiment was used in the present experimental example. In the present embodiment, thirty-one spark plugs 1 (Samples β1 to β31) were prepared with the same dimension in the length La of the tip side portion 81, the length Lb of the base end side portion 82, the total length L of the resistor 6, and the inner diameter D of the insulator 3, while changing the carbon content ratio (C1/C2). In each of the samples (Samples β1 to β31), the length La of the tip side portion 81 was 5 mm, the length Lb of the base end side portion 82 was 5 mm, the total length L of the resistor 6 was 10 mm, and the inner diameter D of the insulator 3 was 3 mm. Further, in all the samples, the length ratio (La/L) in the axial direction X was 0.5. It should be noted that the length ratio (La/L) of 0.5 ($La/L=0.5$) falls in the range of Requirement [1] ($0.1\leq La/L\leq 0.7$) shown in Experimental Example 2, which is preferable in extending the service life of the resistor 6.

The resistance R of the resistor 6 was 0.5 kΩ in Samples β1 to β3, and similarly, 1 kΩ in Samples β4 to β7, 3 kΩ in Samples β8 to β13, 5 kΩ in Samples β14 to β19, 10 kΩ in Samples β20 to β26, and 20 kΩ in Samples β27 to β31. In the present experimental example, the carbon content C1 of the tip side portion 81, and the carbon content C2 of the base end side portion 82 were adjusted so that the resistances R of the respective samples (Samples β1 to β31) became the values set forth above.

Figure 6:
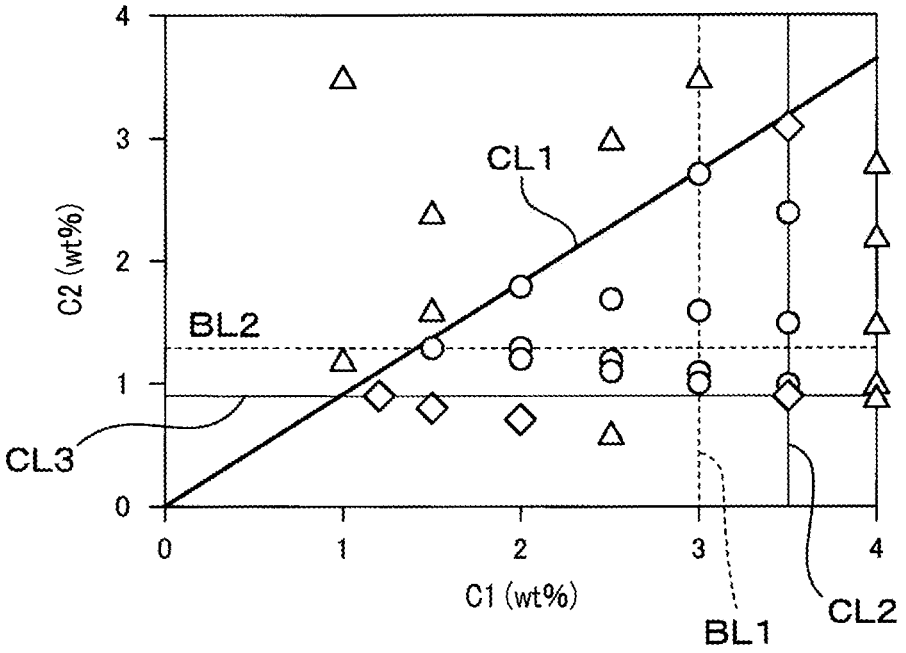
FIG. 6 is a graph showing a relationship of carbon contents C1 and C2 of each sample, with the evaluation on the resistor lifetime in Experimental Example 3.

The test conditions and the evaluation methods of the resistor lifetime in the present experimental example are the same as in Experimental Example 2. The test results of the present experimental example are shown in FIG. 6 and Table 2. In FIG. 6, the horizontal axis represents carbon content C1 of the tip side portion 81 (units: wt %), and the vertical axis represents carbon content C2 of the base end side portion 82 (units: wt %). Relationship of the carbon contents C1 and C2, with the resistor lifetime evaluation of the samples (Samples β1 to β31) is plotted in FIG. 6, based on the test results shown in Table 2. Specifically, the samples having a resistor lifetime of 60 hours or more are plotted with a circular mark. The samples having a resistor lifetime of 40 hours or more to less than 60 hours are plotted with a diamond-shaped mark. The samples having a resistor lifetime of less than 40 hours are plotted with a triangular mark. Namely, the samples plotted with the circular mark in FIG. 6 have the resistor lifetime of Evaluation S. The samples plotted with the diamond-shaped mark have the resistor lifetime Evaluation A. The samples plotted with the triangular mark have the resistor lifetime of Evaluation B. A plurality of straight lines are shown in FIG. 6. These lines indicate the following conditional expressions.

Solid line $CL1$: $C2=(1/1.1)\times C1$

Solid line $CL2$: $C1=3.5$

Solid line $CL3$: $C2=0.9$

Broken line $BL1$: $C1=3.0$

Broken line $BL2$: $C2=1.3$

TABLE 2

| | Carbon content C1 [wt %] | Carbon content C2 [wt %] | C1/C2 [-] | Length La [mm] | Length Lb [mm] | Total length L [mm] | La/L [-] | Inner diameter D [mm] | Resistance R [kΩ] | Resistor lifetime [hr] | Evaluation |
|---|---|---|---|---|---|---|---|---|---|---|---|
| Sample β1 | 4 | 2.8 | 1.4 | 5 | 5 | 10 | 0.5 | 3 | 0.5 | 35 | B |
| Sample β2 | 3.5 | 3.1 | 1.1 | 5 | 5 | 10 | 0.5 | 3 | 0.5 | 40 | A |
| Sample β3 | 3 | 3.5 | 0.9 | 5 | 5 | 10 | 0.5 | 3 | 0.5 | 10 | B |
| Sample β4 | 4 | 2.2 | 1.8 | 5 | 5 | 10 | 0.5 | 3 | 1 | 25 | B |
| Sample β5 | 3.5 | 2.4 | 1.5 | 5 | 5 | 10 | 0.5 | 3 | 1 | 70 | S |
| Sample β6 | 3 | 2.7 | 1.1 | 5 | 5 | 10 | 0.5 | 3 | 1 | 90 | S |
| Sample β7 | 2.5 | 3 | 0.8 | 5 | 5 | 10 | 0.5 | 3 | 1 | 20 | B |
| Sample β8 | 4 | 1.5 | 2.7 | 5 | 5 | 10 | 0.5 | 3 | 3 | 30 | B |
| Sample β9 | 3.5 | 1.5 | 2.3 | 5 | 5 | 10 | 0.5 | 3 | 3 | 60 | S |
| Sample β10 | 3 | 1.6 | 1.9 | 5 | 5 | 10 | 0.5 | 3 | 3 | 70 | S |
| Sample β11 | 2.5 | 1.7 | 1.5 | 5 | 5 | 10 | 0.5 | 3 | 3 | 120 | S |
| Sample β12 | 2 | 1.8 | 1.1 | 5 | 5 | 10 | 0.5 | 3 | 3 | 120 | S |
| Sample β13 | 1.5 | 2.4 | 0.6 | 5 | 5 | 10 | 0.5 | 3 | 3 | 25 | B |
| Sample β14 | 4 | 1 | 4 | 5 | 5 | 10 | 0.5 | 3 | 5 | 30 | B |
| Sample β15 | 3.5 | 1 | 3.5 | 5 | 5 | 10 | 0.5 | 3 | 5 | 60 | S |
| Sample β16 | 3 | 1.1 | 2.7 | 5 | 5 | 10 | 0.5 | 3 | 5 | 70 | S |
| Sample β17 | 2.5 | 1.2 | 2.1 | 5 | 5 | 10 | 0.5 | 3 | 5 | 100 | S |
| Sample β18 | 2 | 1.3 | 1.5 | 5 | 5 | 10 | 0.5 | 3 | 5 | 110 | S |
| Sample β19 | 1.5 | 1.6 | 0.9 | 5 | 5 | 10 | 0.5 | 3 | 5 | 35 | B |
| Sample β20 | 4 | 0.9 | 4.4 | 5 | 5 | 10 | 0.5 | 3 | 10 | 25 | B |
| Sample β21 | 3.5 | 0.9 | 3.9 | 5 | 5 | 10 | 0.5 | 3 | 10 | 50 | A |
| Sample β22 | 3 | 1 | 3 | 5 | 5 | 10 | 0.5 | 3 | 10 | 80 | S |
| Sample β23 | 2.5 | 1.1 | 2.3 | 5 | 5 | 10 | 0.5 | 3 | 10 | 90 | S |
| Sample β24 | 2 | 1.2 | 1.7 | 5 | 5 | 10 | 0.5 | 3 | 10 | 110 | S |
| Sample β25 | 1.5 | 1.3 | 1.2 | 5 | 5 | 10 | 0.5 | 3 | 10 | 100 | S |

TABLE 2-continued

| | Carbon content C1 [wt %] | Carbon content C2 [wt %] | C1/C2 [-] | Length La [mm] | Length Lb [mm] | Total length L [mm] | La/L [-] | Inner diameter D [mm] | Resistance R [kΩ] | Resistor lifetime [hr] | Evaluation |
|---|---|---|---|---|---|---|---|---|---|---|---|
| Sample β26 | 1 | 3.5 | 0.3 | 5 | 5 | 10 | 0.5 | 3 | 10 | 10 | B |
| Sample β27 | 2.5 | 0.6 | 4.2 | 5 | 5 | 10 | 0.5 | 3 | 20 | 20 | B |
| Sample β28 | 2 | 0.7 | 2.9 | 5 | 5 | 10 | 0.5 | 3 | 20 | 40 | A |
| Sample β29 | 1.5 | 0.8 | 1.9 | 5 | 5 | 10 | 0.5 | 3 | 20 | 40 | A |
| Sample β30 | 1.2 | 0.9 | 1.3 | 5 | 5 | 10 | 0.5 | 3 | 20 | 40 | A |
| Sample β31 | 1 | 1.2 | 0.8 | 5 | 5 | 10 | 0.5 | 3 | 20 | 10 | B |

The test results of the present experimental example will be explained. As shown in FIG. 6, from the present experimental example, the samples plotted within the region surrounded by the solid lines CL1, CL2 and CL3 (within the numerical range of a first data region indicated the by three straight lines) have resistor lifetimes of Evaluation A or S. Namely, it is understood from the present experimental example that when the carbon content C1 of the tip side portion 81 and the carbon content C2 of the base end side portion 82 are within the numerical range of the first data region (C1/C2≥1.1, C1≤3.5, and C2≥0.9), the resistor lifetime is 40 hours or more. In the following description, for the sake of convenience, the requirement of the numerical ranges (C1/C2≥1.1, C1≤3.5 and C2≥0.9) of the first data region (numerical requirement of the carbon contents C1 and C2) is referred to as Requirement [2]. Thus, it is understood from the present experimental example that the service life of the resistor 6 is extended by the carbon contents C1 and C2 satisfying Requirement [2]. All the samples plotted in the region surrounded by the solid line CL1 and the broken lines BL1 and BL2 (within the numerical range of a second data region indicated by the three straight lines) in FIG. 6 have resistor lifetimes of Evaluation S. Namely, it is understood from the present experimental example that when the carbon content C1 of the tip side portion 81 and the carbon content C2 of the base end side portion 82 are within the numerical range of the second data region (C1/C2≥1.1, C1≤3.0 and C2≥1.3), the resistor lifetime is 60 hours or more. In the following description, for the sake of convenience, the requirement of the numerical ranges (C1/C2≥1.1, C1<3.0, and C2≥1.3) of the second data region is referred to as Requirement [3]. Thus, it is understood from the present experimental example that when the carbon contents C1 and C2 satisfy Requirement [3], the service life of the resistor 6 is further extended.

Further, from the present experimental example, it is understood, as also from Table 2, that the carbon contents C1 and C2 satisfying Requirement [2], and the resistance R falling in the range of 1 to 10 lead to extending the resistor lifetime to 50 hours or more. In the following description, for the sake of convenience, the requirement of the numerical range of 1 to 10 (1≤R≤10) (numerical requirement of the resistance R) mentioned above is referred to as Requirement [4]. Thus, it is understood from the present experimental example that the service life of the resistor 6 is specifically extended when the carbon contents C1 and C2 satisfy Requirement [2], and the resistance R satisfies Requirement [4].

However, from the present experimental example, it is understood as shown in FIG. 6 and Table 2 that all the samples in which the carbon content C1 is greater than 3.5 (C1>3.5) have resistor lifetimes of less than 40 hours. This is considered to be due to the following reasons. When the carbon content C1 of the tip side portion 81 is increased too much, the contact resistance becomes locally excessive in the boundary surfaces of the tip side portion 81 and the base end side portion 82. As a result, it is considered that generation of Joule heat at the time of energization is promoted, and the resistor lifetime is shortened.

EXPERIMENTAL EXAMPLE 4

In the present experimental example, the total length L of the resistor 6 was changed, in a state of satisfying both of Requirement [1] (0.1≤La/L≤0.7) which was the requirement of the length ratio (La/L) shown in Experimental Example 2, and Requirement [2] (C1/C2≥1.1, C1≤3.5 and C2≥0.9) which was the requirement of the carbon contents C1 and C2 shown in Experimental Example 3. In the present experimental example, the effect of changing the total length L of the resistor 6 on the resistor lifetime was evaluated.

Specifically, the present experimental example used nine spark plugs 1 (Samples γ1 to γ9) satisfying Requirements [1] and [2], with the total length L of the resistor 6 being changed within the range of 5 to 15 mm. The samples (Samples γ1 to γ9) had the same dimension in the inner diameter D of the insulator 3, and the same resistance R of the entirety of the resistor 6. Namely, in each sample, the inner diameter D of the insulator 3 was 3 mm, and the resistance R of the resistor 6 was 5 kΩ.

In Samples γ1 to γ3, the carbon content ratio (C1/C2), and the length ratio (La/L) in the axial direction X were fixed, and the total length L of the resistor 6 was changed. The same applies to Samples γ4 to γ6 and Samples γ7 to γ9. Specifically, the total length L of the resistor 6 was 10 mm in Samples γ1, γ4 and γ7, and similarly, 5 mm in Samples γ2, γ5 and γ8, and 15 mm in Samples γ3, γ6 and γ9. Further, in Samples γ1 to γ3, the carbon content ratio of the tip side relative to the base end side (C1/C2) was 1.3, and the length ratio (La/L) in the axial direction X was 0.1. In Samples γ4 to γ6, the carbon content ratio (C1/C2) was 1.3, and the length ratio (La/L) was 0.7. In Samples γ7 to γ9, the carbon content ratio (C1/C2) was 1.1, and the length ratio (La/L)

was 0.5. In the present experimental example, the carbon content C1 of the tip side portion 81, and the carbon content C2 of the base end side portion 82 were adjusted in each of the samples (Samples γ1 to γ9) so that the resistance R was the abovementioned 5 kΩ.

The test conditions and the evaluation methods of the resistor lifetime in the present experimental example are the same as in Experimental Examples 2 and 3. The test results of the present experimental example are shown in Table 3.

Specifically, in the present experimental example, nine spark plugs 1 (Samples δ1 to δ9) satisfying Requirements [1] and [2] were prepared, with the inner diameter D of the insulator 3 being changed within the range of 2 to 4 mm. The samples (Samples γ1 to γ9) had the same dimension in the entire length L of the resistor 6, and the same resistance R of the entirety of the resistor 6. Namely, in each sample, the total length L of the resistor 6 was 10 mm, and the resistance R of the resistor 6 was 5 kΩ.

TABLE 3

| | Carbon content C1 [wt %] | Carbon content C2 [wt %] | C1/C2 [-] | Length La [mm] | Length Lb [mm] | Total length L [mm] | La/L [-] | Inner diameter D [mm] | Resistance R [kΩ] | Resistor lifetime [hr] | Evaluation |
|---|---|---|---|---|---|---|---|---|---|---|---|
| Sample γ1 | 2.1 | 1.6 | 1.3 | 1 | 9 | 10 | 0.1 | 3 | 5 | 80 | S |
| Sample γ2 | 1.9 | 1.5 | 1.3 | 0.5 | 4.5 | 5 | 0.1 | 3 | 5 | 60 | S |
| Sample γ3 | 2.2 | 1.7 | 1.3 | 1.5 | 13.5 | 15 | 0.1 | 3 | 5 | 100 | S |
| Sample γ4 | 2.2 | 1.7 | 1.3 | 7 | 3 | 10 | 0.7 | 3 | 5 | 70 | S |
| Sample γ5 | 2 | 1.5 | 1.3 | 3.5 | 1.5 | 5 | 0.7 | 3 | 5 | 50 | A |
| Sample γ6 | 2.4 | 1.8 | 1.3 | 10.5 | 4.5 | 15 | 0.7 | 3 | 5 | 80 | S |
| Sample γ7 | 1.7 | 1.5 | 1.1 | 5 | 5 | 10 | 0.5 | 3 | 5 | 80 | S |
| Sample γ8 | 1.5 | 1.4 | 1.1 | 2.5 | 2.5 | 5 | 0.5 | 3 | 5 | 70 | S |
| Sample γ9 | 2 | 1.8 | 1.1 | 7.5 | 7.5 | 15 | 0.5 | 3 | 5 | 100 | S |

The test results of the present experimental example will be explained. As shown in Table 3, it is understood from the present experimental example that when the length ratio (La/L) in the axial direction X satisfies Requirement [1], and the carbon contents C1 and C2 satisfy Requirement [2], the resistor lifetime becomes 40 is or more. Moreover, it is understood that when Requirements [1] and [2] are satisfied, even if the total length L of the resistor 6 is changed within the range of 5 to 15 mm, the resistor lifetime is 40 hours or more, and the service life of the resistor 6 is extended. Studying the results of Samples γ1 to γ3, Samples γ4 to γ6 and Samples γ7 to γ9, it is understood from the present experimental example that the longer the total length L of the resistor 6 is, the longer the resistor lifetime tends to become.

EXPERIMENTAL EXAMPLE 5

In the present experimental example, similarly to Experimental Example 4, the inner diameter D of the insulator 3 was changed in a state of satisfying both of Requirement [1] ($0.1 \leq La/L \leq 0.7$) of the length ratio (La/L), and, Requirement [2] ($C1/C2 \geq 1.1$, $C1 \leq 3.5$ and $C2 \geq 0.9$) of the carbon contents C1 and C2. In the present experimental example, the effect of changing the inner diameter D of the insulator 3, on the resistor lifetime was evaluated.

In Samples δ1 to δ3, the carbon content ratio (C1/C2), and the length ratio (La/L) in the axial direction X were fixed, and the inner diameter D of the insulator 3 was changed. The same applies to Samples γ4 to γ6 and Samples γ7 to γ9. Specifically, the inner diameter D of the insulator 3 was 3 mm in Samples δ1, δ4 and δ7, and similarly, 2 mm in Samples δ2, δ5 and δ8, and 4 mm in Samples δ3, δ6 and δ9. In Samples δ1 to δ3, the carbon content ratio (C1/C2) on the tip side, relative to that on the base end side was 1.3, and the length ratio (La/L) in the axial direction X was 0.1. In Samples δ4 to δ6, the carbon content ratio (C1/C2) was 1.3, and the length ratio (La/L) was 0.7. In Samples δ7 to δ9, the carbon content ratio (C1/C2) was 1.1, and the length ratio (La/L) was 0.5. The carbon content C1 of the tip side portion 81, and the carbon content C2 of the base end side portion 82 were adjusted in each of the samples (Samples γ1 to γ9) so that the resistance R was 5 kΩ mentioned above. Samples δ1, δ4 and δ7 of the present experimental example are Samples γ1, γ4 and γ7 used in Experimental Example 4.

Similarly to Experimental Example 4, the test conditions of the present experimental example and the evaluation methods of the resistor lifetime are the same as in Experimental examples 2 and 3. The test results of the present experimental example are shown in Table 4.

TABLE 4

| | Carbon content C1 [wt %] | Carbon content C2 [wt %] | C1/C2 [-] | Length La [mm] | Length Lb [mm] | Total length L [mm] | La/L [-] | Inner diameter D [mm] | Resistance R [kΩ] | Resistor lifetime [hr] | Evaluation |
|---|---|---|---|---|---|---|---|---|---|---|---|
| Sample δ1 | 2.1 | 1.6 | 1.3 | 1 | 9 | 10 | 0.1 | 3 | 5 | 80 | S |
| Sample δ2 | 2.3 | 1.8 | 1.3 | 1 | 9 | 10 | 0.1 | 2 | 5 | 70 | S |
| Sample δ3 | 1.8 | 1.4 | 1.3 | 1 | 9 | 10 | 0.1 | 4 | 5 | 110 | S |
| Sample δ4 | 2.2 | 1.7 | 1.3 | 7 | 3 | 10 | 0.7 | 3 | 5 | 70 | S |
| Sample δ5 | 2.3 | 1.8 | 1.3 | 7 | 3 | 10 | 0.7 | 2 | 5 | 60 | S |
| Sample δ6 | 1.9 | 1.5 | 1.3 | 7 | 3 | 10 | 0.7 | 4 | 5 | 80 | S |
| Sample δ7 | 1.7 | 1.5 | 1.1 | 5 | 5 | 10 | 0.5 | 3 | 5 | 80 | S |
| Sample δ8 | 1.9 | 1.7 | 1.1 | 5 | 5 | 10 | 0.5 | 2 | 5 | 80 | S |
| Sample δ9 | 1.5 | 1.4 | 1.1 | 5 | 5 | 10 | 0.5 | 4 | 5 | 110 | S |

The test results of the present experimental example will be explained. As shown in Table 4, it is understood from the present experimental example that when the length ration (La/L) in the axial direction X satisfies Requirement [1], and the carbon contents C1 and C2 satisfy Requirement [2], the resistor lifetime is 40 hours or more. It is understood that when Requirements [1] and [2] are satisfied, even if the inner diameter D of the insulator 3 is changed within the range of 2 to 4 mm, the resistor lifetime is 40 hours or more, and the service life of the resistor 6 is extended. Studying the results of Samples δ1 to δ3, Samples δ4 to δ6 and Samples δ7 to δ9, it is also understood from the present experimental example that the larger the inner diameter D of the insulator 3 is, the longer the resistor lifetime tends to become.

REFERENCE SIGNS LIST

1: Spark plug for internal combustion engine
2: Housing
3: Insulator
4: Center electrode
5: Ground electrode
6: Resistor
61: First region
62: Second region
7: Terminal bracket
8: Uniform portion
81: Tip side portion
82: Base end side portion
G: Spark discharge gap
X: Axial direction

The invention claimed is:

1. A spark plug for an internal combustion engine comprising a cylindrical housing;

a cylindrical insulator held on the inside of the housing;

a center electrode held on the inside of the insulator so that a tip end of the center electrode is project from the insulator;

a terminal bracket held on the inside of the insulator so that a base end of the terminal bracket is projected from the insulator;

a ground electrode forming a spark discharge gap between the ground electrode and the center electrode; and a resistor containing carbon disposed on the inside of the insulator so as to be located between the center electrode and the terminal bracket, wherein:

in an axial direction of the spark plug, the resistor has a higher carbon content in a first region positioned closer to a tip side than a center of the resistor is, compared to a second region positioned closer to a base end side than the center of the resistor is the resistor includes at least two uniform portions in the axial direction, each uniform portion having a uniform carbon content;

at least one of the uniform portions of the resistor serves as a tip side portion disposed on the tip side of the resistor; and the tip side portion of the resistor has a carbon content higher than a carbon content of another uniform portion.

2. The spark plug for an internal combustion engine according to claim 1, wherein:

the resistor includes two uniform portions that include the tip side portion, and a base end side portion which corresponds to the uniform portion disposed on the base end side of the resistor; and when the tip side has a length [mm] La in the axial direction, the tip side portion has a carbon content [wt %] C1, the base end side portion has a carbon content [wt %] C2, and the resistor has a length [mm] L in the axial direction, L, La, C1 and C2 satisfy the following Requirements [1] and [2] expressed by:

$$0.1 \leq La/L \leq 0.7 \quad [1]$$

$$C1/C2 \geq 1.1,\ C1 \leq 3.5 \text{ and } C2 \geq 0.9 \quad [2].$$

3. The spark plug for an internal combustion engine according to claim 2, wherein C1 and C2 satisfy the following Requirement [3] expressed by:

$$C1 \leq 3.0 \text{ and } C2 > 1.3 \quad [3].$$

* * * * *